US010661300B2

(12) United States Patent
Chase et al.

(10) Patent No.: US 10,661,300 B2
(45) Date of Patent: May 26, 2020

(54) METHOD OF PAINTING A PLASTIC WORK PIECE USING AN ELECTROSTATICALLY ISOLATED MASK

(71) Applicant: Lacks Enterprises, Inc., Grand Rapids, MI (US)

(72) Inventors: Lee Chase, Grand Rapids, MI (US); Scott Stuart, East Grand Rapids, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 398 days.

(21) Appl. No.: 15/354,621

(22) Filed: Nov. 17, 2016

(65) Prior Publication Data

US 2017/0136491 A1 May 18, 2017

Related U.S. Application Data

(60) Provisional application No. 62/256,990, filed on Nov. 18, 2015.

(51) Int. Cl.

| | |
|---|---|
| ***B05D 1/04*** | (2006.01) |
| ***B05D 3/00*** | (2006.01) |
| ***B05D 1/32*** | (2006.01) |
| ***B05D 7/00*** | (2006.01) |
| ***B05B 12/20*** | (2018.01) |
| *B05D 7/02* | (2006.01) |

(52) U.S. Cl.

CPC ..... *B05D 1/04* (2013.01); *B05B 12/20* (2018.02); *B05D 1/045* (2013.01); *B05D 1/322* (2013.01); *B05D 3/007* (2013.01); *B05D 7/52* (2013.01); *B05D 1/32* (2013.01); *B05D 7/02* (2013.01)

(58) Field of Classification Search

CPC . B05D 1/04; B05D 1/045; B05D 7/52; B05D 3/007; B05D 1/322; B05D 1/32; B05D 7/02; B05B 12/20

See application file for complete search history.

(56) References Cited

U.S. PATENT DOCUMENTS

| | | | |
|---|---|---|---|
| 5,096,761 | A | 3/1992 | Roberts et al. |
| 5,753,042 | A | 5/1998 | Bauer |
| 6,455,110 | B1 | 9/2002 | Fortuyn et al. |
| 8,632,864 | B2 | 1/2014 | Hao et al. |
| 8,828,197 | B2 | 9/2014 | Ryan et al. |

(Continued)

FOREIGN PATENT DOCUMENTS

| | | | |
|---|---|---|---|
| WO | 9608318 | A1 | 3/1996 |

*Primary Examiner* — John C Hong

(74) *Attorney, Agent, or Firm* — Dickinson Wright PLLC

(57) ABSTRACT

A method for painting a work piece of plastic material. The method includes applying a first coating of an electrically conductive material to the work piece and electrically grounding the first coating. The method also includes electrostatically charging a paint to render the paint conductive for statically attracting the conductive paint toward the grounded first coating of the work piece. The method also includes overlying a mask of a non-conductive material over at least a portion of the first coating of the work piece and electrically insulating the mask. The work piece is then sprayed with the conductive paint to apply a layer of paint on the first coating with the mask preventing the conductive paint from being applied on the portions of the first coating of the work piece that are covered by the mask.

20 Claims, 8 Drawing Sheets

(56) References Cited

U.S. PATENT DOCUMENTS

| | | | | |
|---|---|---|---|---|
| 9,975,312 | B2 * | 5/2018 | Shen | B29C 45/1671 |
| 2011/0240343 | A1 * | 10/2011 | Zagdoun | C03C 17/002 174/250 |

* cited by examiner

METHOD OF PAINTING A PLASTIC WORK PIECE USING AN ELECTROSTATICALLY ISOLATED MASK

CROSS-REFERENCE TO RELATED APPLICATIONS

This U.S. patent application claims the benefit of U.S. Provisional Patent Application Ser. No. 62/256,990 filed Nov. 18, 2015, entitled "Method of Painting a Plastic Work Piece Using an Electrostatically Isolated Mask," the entire disclosure of the application being considered part of the disclosure of this application and hereby incorporated by reference.

TECHNICAL FIELD

The present disclosure relates generally to improved aesthetics for plastic work pieces. More specifically, the present disclosure relates to a method of improving the aesthetics of a plastic work piece through the provision of multiple painted finishes.

BACKGROUND OF THE DISCLOSURE

Painted decorative finishes have long been available for various products in industries such as the automotive, appliance, consumer electronics, and household application industries. However, variations in paint deposition methods have resulted in the aesthetics of the final product being undesirable.

It is also known in the art that plastic work pieces may be masked prior to being painted with spraying mechanisms in order to provide a multiple painted finish, i.e., two-tone, appearance of the work piece. To provide a two-tone appearance on large work pieces like fascias or bumpers of automobiles, it is known that the work piece may be masked by manually applying a tape thereto prior to painting. Once the paint has cured, the tape may be peeled off revealing the two-tone appearance of the work piece. An issue with this masking technique is that it is very labor intensive and the consistency of the process can be poor since the tape is aligned and applied by hand.

To provide a two-tone appearance on smaller or more intricate work pieces such as grilles and wheel covers, it is known to cover portions of the work piece with rigid metal masks. Such masks provide for certain advantages over taping methods. Notably, they can be more quickly attached to the work piece and tend to be more consistently aligned since automated fixtures can be utilized to attach and remove the mask. The downside to using such masks, however, is that the transfer efficiency, i.e., the percentage of paint that is sprayed and which successfully makes it onto the work piece, can be quite low—sometimes less than 20%.

In traditional non-masked spray painting operations (that don't involve creating a two-tone appearance), it is known to utilize electrostatic spray painting techniques to improve the transfer efficiency to 55% or higher on work pieces. In such electrostatic spray painting operations, the work piece is generally made of a conductive material. The painting operation includes the steps of grounding the work piece, electrostatically charging a paint to render the paint conductive for statically attracting the conductive paint toward the grounded work piece, and spraying the work piece with the conductive paint. To allow plastic work pieces to be painted in such electrostatic spray painting operations, it is known to apply a conductive coating on the work piece prior to painting (e.g., as disclosed in U.S. Pat. No. 6,455,110 to Fortuyn et al.).

Metal masks are generally not utilized in electrostatic spray painting operations to provide a two-tone appearance of work pieces because the metal masks are conductive, which can cause a large amount of paint to be attracted to and applied to the mask instead of the work piece.

As such, there remains a need for improved methods of painting plastic work pieces to yield a two-tone appearance that are efficient and provide for high transfer efficiencies.

SUMMARY OF THE DISCLOSURE

It is therefore an aspect of the disclosure to provide a method for painting a plastic work piece that provides increased paint transfer efficiency to the work piece.

It is another aspect of the disclosure to provide a method for painting a multi-finish on a plastic work piece involving use of a mask to create a multi-appearance finish that is cleaner since very little paint is sprayed onto the mask or surrounding components.

It is yet another aspect of the disclosure to provide a method of painting a plastic work piece that allows utilization of various spray patterns with minimal complexity as compared to prior art spray patterns.

It is still a related aspect of the disclosure to provide a method of painting a plastic work piece that allows atomized clouds to be sprayed near the work piece rather than having to be directed at specific areas of the work piece.

It is a further aspect of the disclosure to provide a method of paining a plastic work piece that allows for improved sharpness of edges between two-tone paint color variations.

According to the above and the other aspects, a method for painting a plastic work piece is provided. According to the method, a first coating of an electrically conductive material may be applied to the work piece. The first coating is then electrically grounded. A paint to be applied to a surface of the work piece may be electrostatically charged to render the paint conductive for statically attracting the conductive paint toward the grounded first coating of the work piece. A mask may be disposed over at least a portion of the first coating and then the conductive paint may be applied to the exposed first coating to provide a layer of paint thereon. The mask is electrically insulated from the first coating of the work piece to prevent the conductive paint from being statically attracted toward the mask to increase the transfer efficiency of the conductive paint transferred to the first coating on the work piece.

BRIEF DESCRIPTION OF THE DRAWINGS

Other aspects of the present disclosure will be readily appreciated, as the same becomes better understood by reference to the following detailed description when considered in connection with the accompanying drawings wherein.

DESCRIPTION OF THE PREFERRED EMBODIMENTS

Referring to the Figures, wherein like numerals indicate corresponding components throughout the several views, methods are generally shown for painting plastic work pieces 10. It should be appreciated that the term "plastic" as used herein encompasses various types of organic polymer materials.

Figure 1:
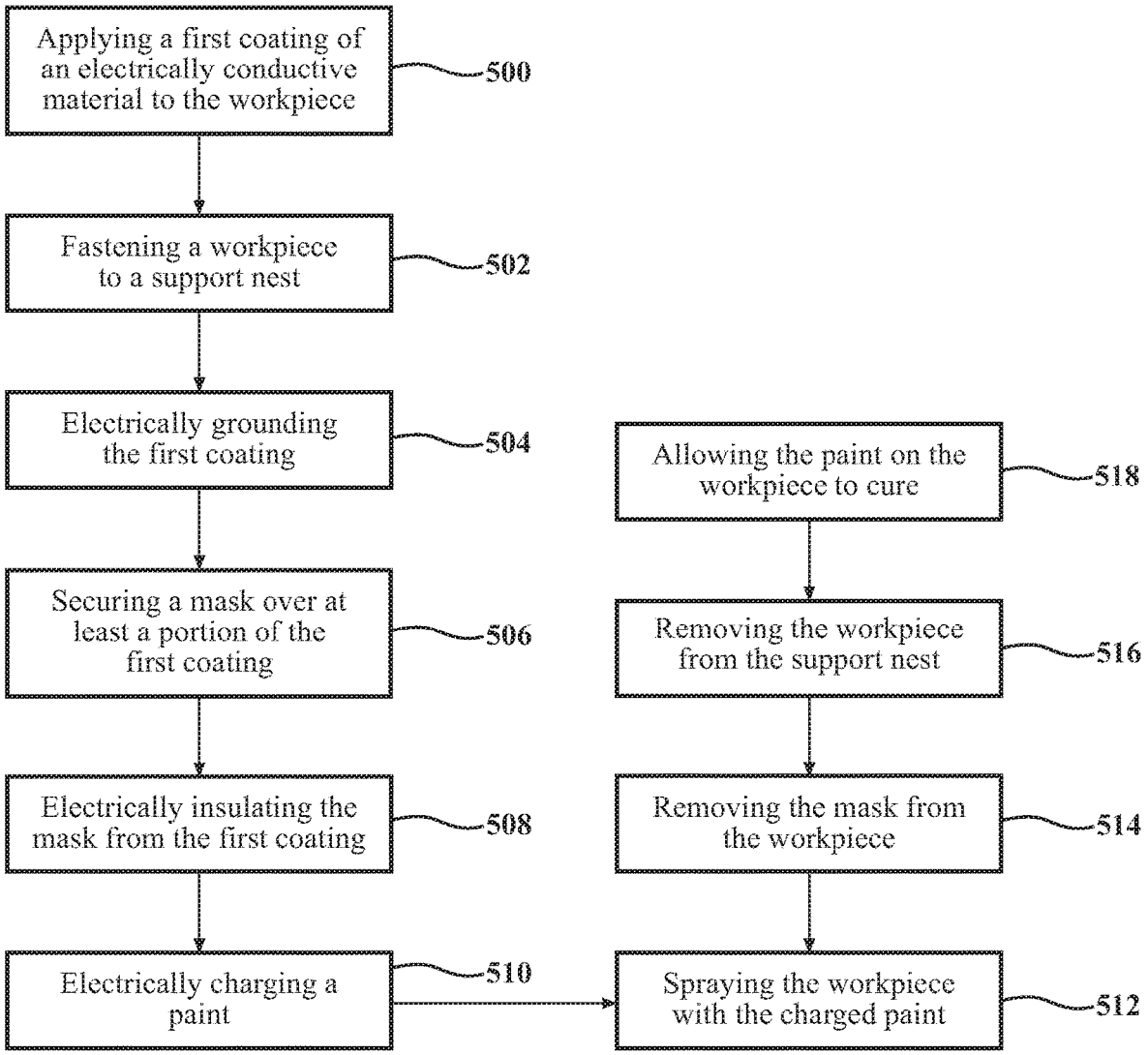
FIG. 1 is a flow diagram of an embodiment of a method for painting a work piece of plastic material in accordance with an aspect of the present disclosure.
Figure 2:
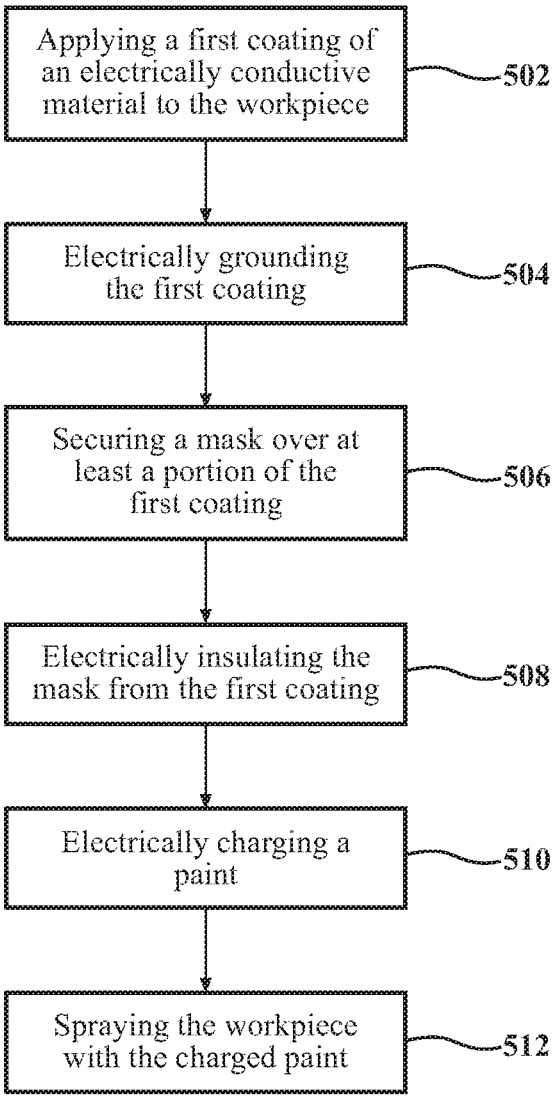
FIG. 2 is a flow diagram of an additional embodiment of a method for painting a work piece of plastic material in accordance with an aspect of the present disclosure.

According to an aspect, as exemplarily shown in FIGS. 1-2, the method generally includes the step 500 of applying a first coating of an electrically conductive material to a work piece 10. According to an aspect, the step 500 of applying the first coating of the electrically conductive material to the work piece 10 may include utilizing an electroplating process, a physical vapor deposition process, a sputtering deposition process, a vacuum metalizing process, adding conductive pigments to the plastic material of the work piece 10, or molding a Mylar film about the work piece. Suitable conductive materials that may be utilized to form the first coating according to the subject method may include, but are not limited to, copper, nickel, zinc, palladium, gold, chromium (i.e., chrome), and alloys thereof. Other suitable processes for applying the coating may also be employed. According to a further aspect, the first coating may also be paint.

According to a further aspect, after the step 500, the method may include the step 502 of fastening a work piece 10 to a fixture 12, 112, 212 that is configured for holding the work piece 10 in position during an electrostatic spray painting operation. The fixture 12, 112, 212 could have various shapes and sizes and could be made out of various materials. Further, the fixture 12, 112, 212 may be stationary or moveable. According to another aspect, the fixture 12, 112, 212 may include a nest into which the work piece 10 may rest.

After the first coating is applied to the work piece 10, according to another aspect, the method can proceed with step 504 of electrically grounding the first coating of the work piece 10. As will be explained in further detail below, the process of electrically grounding the work piece 10 may include electrically contacting a grounding connection to the work piece 10 alone, to the entirety of the fixture 12, 112, 212, or to a specific portion of the fixture 12, 112, 212 (e.g., a tab) that is in engagement with the work piece 10. The first coating may also be ground in other suitable ways.

Before or after the first coating is electrically grounded, the method can include the step 506 of securing a mask 14, 114, 214 over at least a portion of the first coating of the work piece 10 for the purpose of preventing the application of paint on the portions of the first coating of the work piece 10 that are covered by the mask 14, 114, 214 during subsequent painting operations. Accordingly, once the mask 14, 114, 214 is secured to the work piece 10, the work piece 10 may be painted to achieve a two-tone color appearance since portions of the work piece 10 are covered and other portions are not. It will be appreciated that more than two tones may be employed depending upon the number of masks that may be employed.

During or after connecting the mask to the work piece 10, the method can also include the step 508 of electrically insulating the mask 14, 114, 214 from the first coating on the work piece 10 to prevent conductive paint from being statically attracted toward the mask 14, 114, 214. As will be explained in greater detailed below, electrically insulating the mask 14, 114, 214 from the work piece 10 can improve the electrostatic spray painting operations because the electrically charged paint is drawn only to portions of the work piece 10 that are not masked, thereby increasing the transfer efficiency of paint that is applied to the work piece 10 rather than the mask 14, 114, 214 and surrounding components.

According to an aspect, the step 508 of electrically insulating the mask 14, 114, 214 may include utilizing a mask 14, 114, 214 that is made of a non-conductive, rigid, and resilient material such as a plastic. It should be appreciated that constructing the mask 14, 114, 214 of plastic material not only electrically insulates the mask 14, 114, 214 from the first coating of the work piece 10, but also allows it to be easily and accurately positioned over the work piece 10 by way of automated processes because it is sufficiently rigid and durable. Such a plastic mask 14, 114, 214 may be formed by way of an injection molding process, a three-dimensional printing process, a thermoforming process, and the like. It will be appreciated that the plastic mask can take on a variety of suitable shapes.

It will be appreciated that other techniques may be utilized to electrically insulate the mask from the first coating of the work piece. According to an aspect, a plastic or rubber insulator may be employed between the mask 14 and the work piece 10. According to a still further aspect, a two-shot molded plastic mask having a portion formed of a rigid material and another portion formed of a flexible material, which conforms to a surface of the work piece may be employed.

After the first coating of the work piece 10 has been grounded, the method can proceed with step 510 of electrostatically charging a paint to make it conductive, and then step 512 of spraying the work piece 10 with the charged paint to apply a layer of paint on the first coating on a portion of the work piece. As is known, electrostatically charging the paint renders the paint conductive for attracting it toward the grounded first coating of the work piece 10. To provide for the electrostatic charge, paint particles, i.e., droplets, may be charged by an electrode in a spray head of a painting device, thereby creating a cloud of charged paint particles, which are drawn toward the work piece 10 but not the mask 14, 114, 214 which may be electrically insulated from the work piece 10.

After the work piece 10 has been sprayed with the electrically charged paint, the method may proceed with step 514 of removing the mask 14, 114, 214 from the work piece 10 and 516 removing the work piece 10 from the fixture 12, 112, 212. The method may then proceed with step 518 of allowing the paint on the work piece 10 to cure. According to an aspect, the step of curing the work piece 10 may include utilizing a thermal curing process, an ultraviolet curing process or the like.

It should be appreciated that numerous benefits can be provided by utilizing a mask 14, 114, 214 that is electrically-insulated from the work piece 10 in accordance with at least some of the aspects discussed herein. Among these include increased transfer efficiency of paint that is applied to the work piece 10 as the electrically charged paint is only attracted to the work piece (not the mask or surrounding components). This provides a cleaner work area as well as reduced paint waste since more paint is drawn to the work piece 10 rather than surrounding components. The electrically insulated mask 14, 114, 214 can also provide improved sharpness of two-tone separation lines on the work piece 10 because the paint is drawn to the work piece 10 rather than being forced through gaps in the mask 14, 114, 214. Furthermore, spray patterns with minimal complexity may be utilized during the spraying process since an atomized cloud may merely be generally directed toward the work piece 10 since the charged paint is drawn only toward the work piece 10 (rather than having to focus the nozzle on different parts of the work piece 10).

Figure 3:
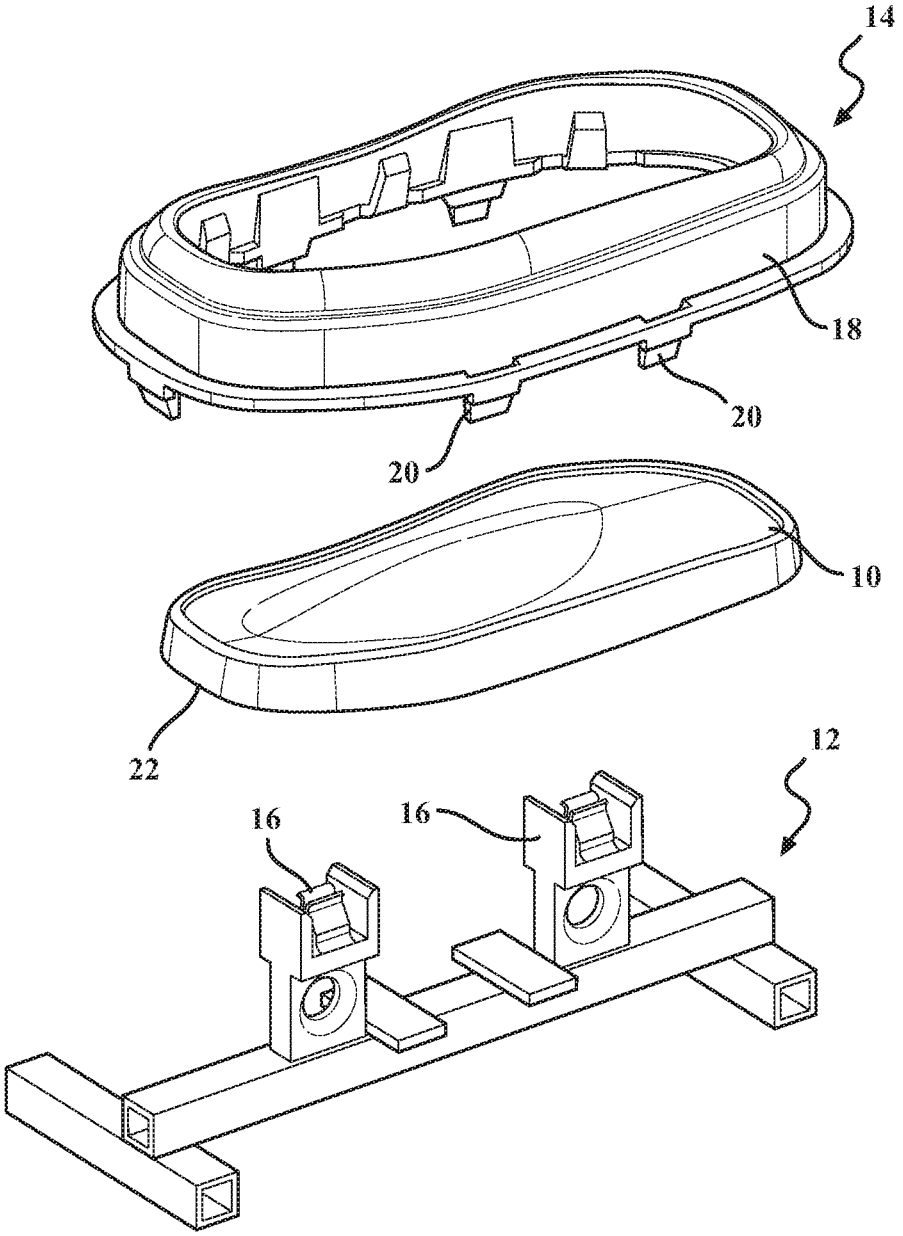
FIG. 3 is a perspective view of a mask and fixture assembly according to another aspect of the disclosure.

Various systems may be utilized to attach the fixture 12, 112, 212, mask 14, 114, 214, and work piece 10 to one another. According to an aspect, as shown in FIG. 3, a "snap-on" style system may be utilized for this purpose. According to this aspect, a pair of connecting elements, such as clips 16, can extend upwardly from a fixture 12 in parallel relationship with one another. The clips 16 can engage corresponding connecting elements, such as protrusions (not shown), on the work piece 10 for holding the work piece 10 in place during the painting operation. It should be appreciated that any number of clips 16 could be utilized and that the clips 16 could be positioned in various configurations. It should further appreciate that the work piece 10 may be grounded by way of the interface between the work piece 10 and clips 16. According to an aspect, a snap-on mask 14 may be connected to the work piece 10. The mask 14 can include an outer wall 18 that extends in a continuous loop shape for being disposed about areas of the mask 14 on which painting is not desired. It should be appreciated that the outer wall 18 of the mask 14 could have various shapes and sizes to correspond with particular a work piece 10 on which it is attached. Further, a plurality of snap tabs 20 may be integrally connected with the outer wall 18 of the mask 14. The snap tabs 20 can extend downwardly from the outer wall 18 for engaging the work piece 10 to secure the mask 14 to the work piece 10. In this example, the snap tabs 20 can engage a bottom periphery 22 of the work piece 10 since it is generally not desirable to coat the bottom periphery 22. It should be appreciated, however, that the snap tabs 20 could engage other areas of the work piece 10 that are not intended to be coated such that they do not interfere with coating areas of the work piece 10 that are intended to be coated.

Figure 4A:
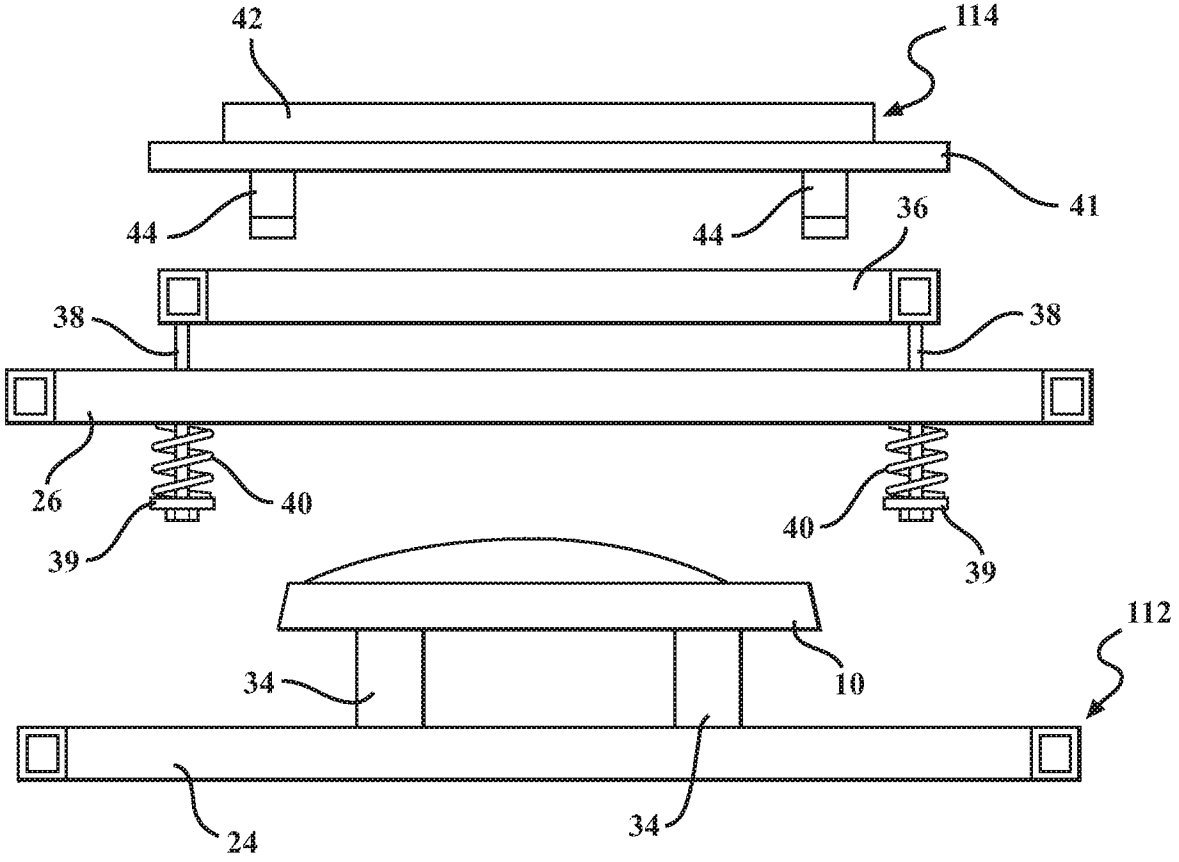
FIG. 4A is a side view of a mask and fixture assembly according to another aspect of the disclosure.
Figure 4B:
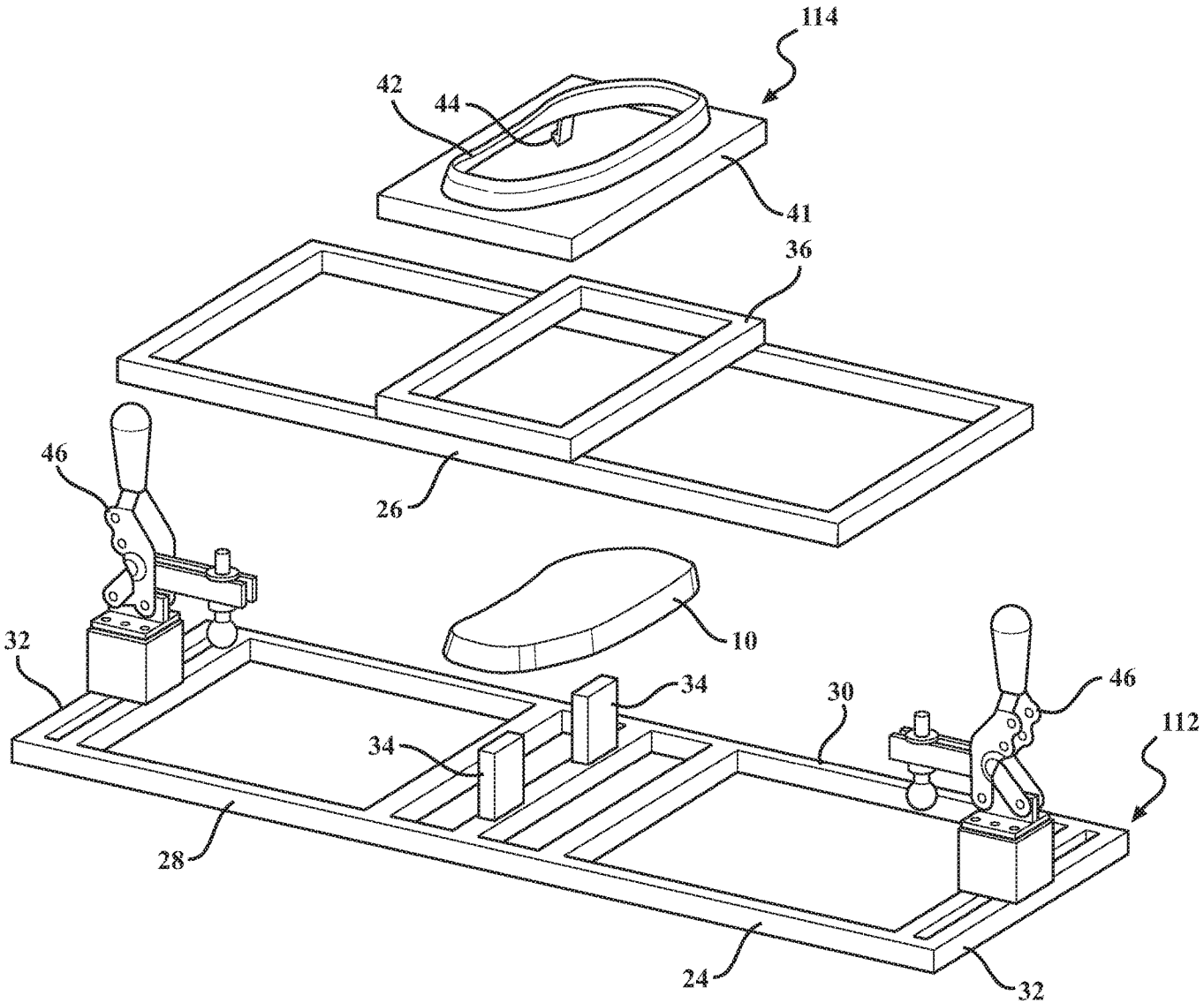
FIG. 4B is a perspective exploded view of the mask and fixture assembly of FIG. 4A.
Figure 4C:
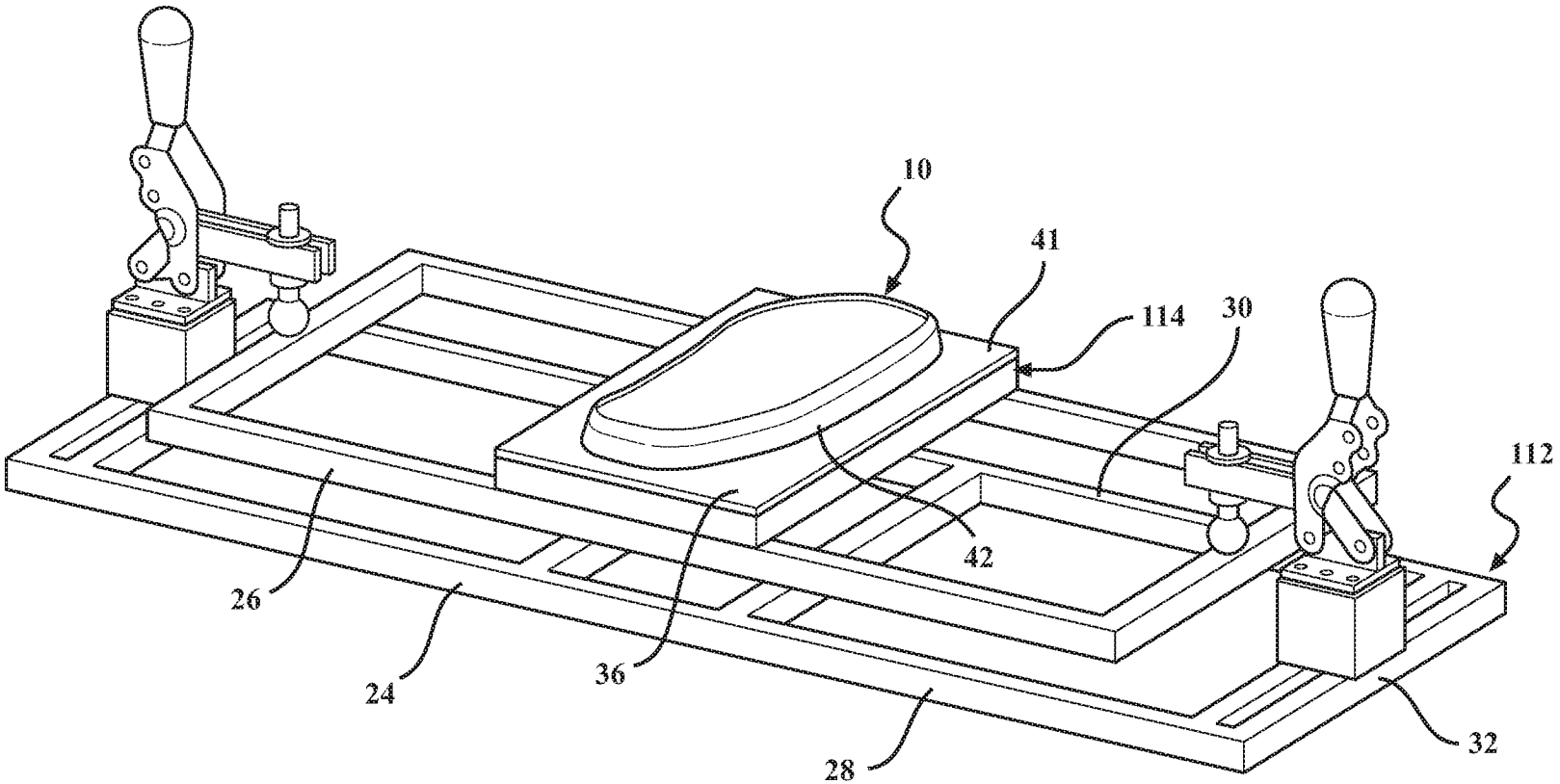
FIG. 4C is a perspective view of the mask and fixture assembly of FIG. 4A.
Figure 4D:
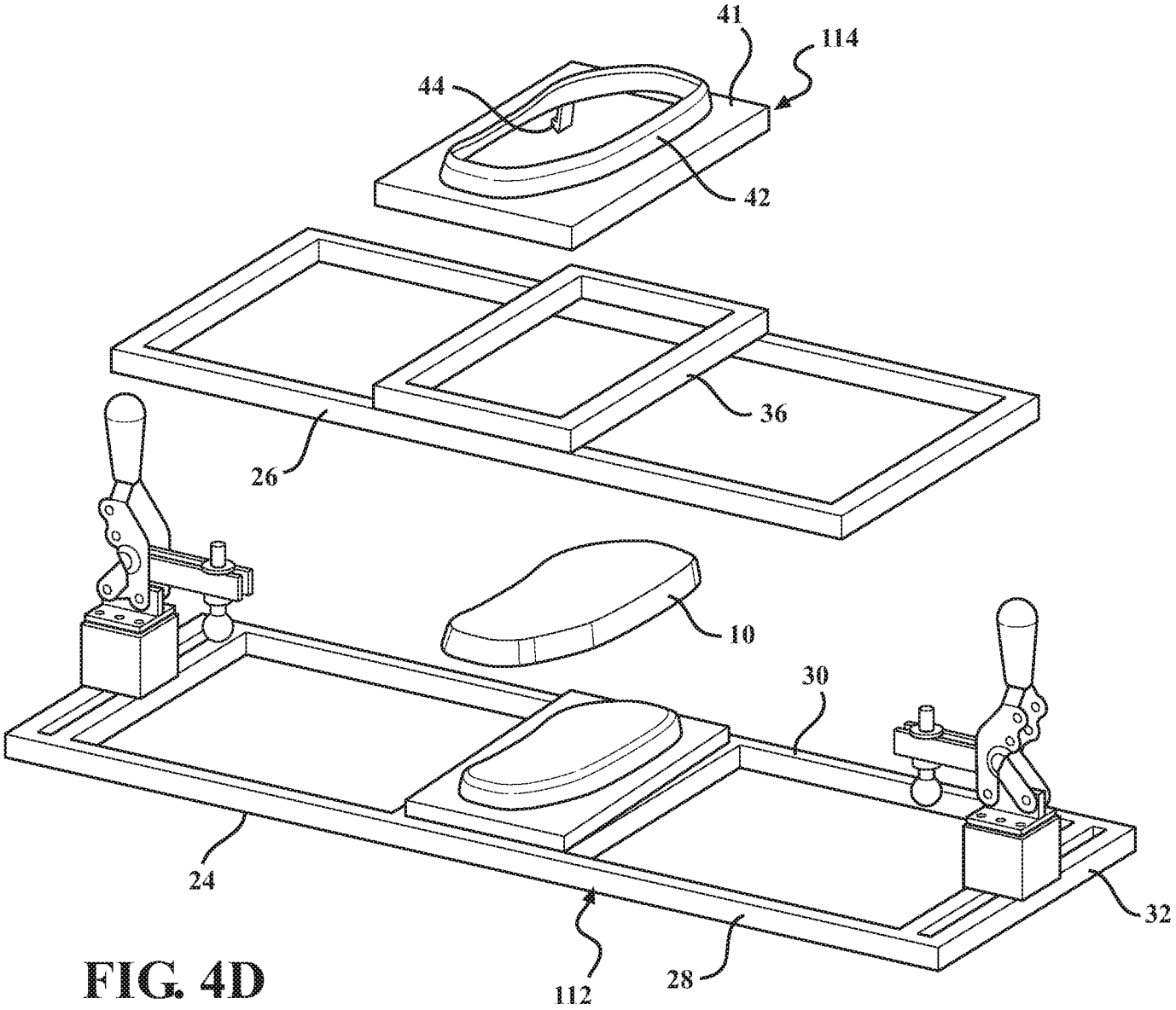
FIG. 4D is a perspective exploded view of the mask and fixture assembly of FIG. 4A illustrating the fixture without clips according to a further aspect of the disclosure.

According to a further aspect, as best presented in FIGS. 4A-4D, a "Rack to Rack" style system may be utilized. According to this aspect, the fixture 112 can include a lower rack 24 and an upper rack 26. With reference to FIGS. 4B-4D, the lower rack 24 may include a front beam 28, a rear beam 30 and a pair of side beams 32. As best presented in FIG. 4B, a pair of clips 34 may extend upwardly from the lower rack 24 between the front and rear beams 28, 30 for supporting and/or engaging the work piece 10. It should further be appreciated that the work piece 10 may be grounded by way of the interface between the work piece 10 and the clips 34. It should be appreciated that any number of pairs of clips 34 could be utilized to accommodate the placement of any number of work pieces 10 on the fixture 112. It should further be appreciated that the lower rack 24 may include no clips 34 (as best shown in FIG. 4D), allowing the work piece 10 to be entirely supported by the mask 114. The upper rack 26 may be disposed above the lower rack 24 and is in alignment with the lower rack 24. A carrier 36 may be attached to the upper rack 26 for supporting the mask 114. It should be appreciated that any number of carriers 36 could be utilized to accommodate more than one mask.

As shown in FIG. 4A, a plurality of pins 38 can extend downwardly from the carrier 36 and slideably extend through the upper rack 26 of the fixture 112. A stopping washer 39 may be fixedly disposed about an end of each of the pins 38. A spring 40 may be disposed about each of the pins 38 between the upper rack 26 and one of the stopping washers 39 for biasing the upper rack 26 in an elevated position. The mask 114 can include a flat plate portion 41 and an outer wall 42 that extends upwardly from the flat plate portion 41 in a continuous loop shape for being disposed about the areas of the work piece 10 on which plating is not desired. Further, a plurality of snap tabs 44 may be integrally connected with the outer wall 42 and can extend downwardly from the outer wall 42 for engaging the carrier 36 to connect the mask 114 and the part carrier 36 with the mask 114 disposed about the work piece 10. A pair of clamps 46 can each be connected to one of the side beams 32 of the lower rack 24 of the fixture 112 for releasably securing the lower rack 24 to the upper rack 26. It should be appreciated that the configuration of the clamps 46, the carrier 36 and the mask 114 allow the mask 114 to quickly and easily be secured to the work piece 10 with the mask being semi-permanently connected to the fixture 112. More specifically, after the work piece 10 is attached to the clips 34, the mask 114 can be easily lowered onto or in communication with the work piece 10 by way of the clamps 46. After the coating operation, the mask 114 may be released from the work piece 10 by releasing the clamps 46.

Figure 5:
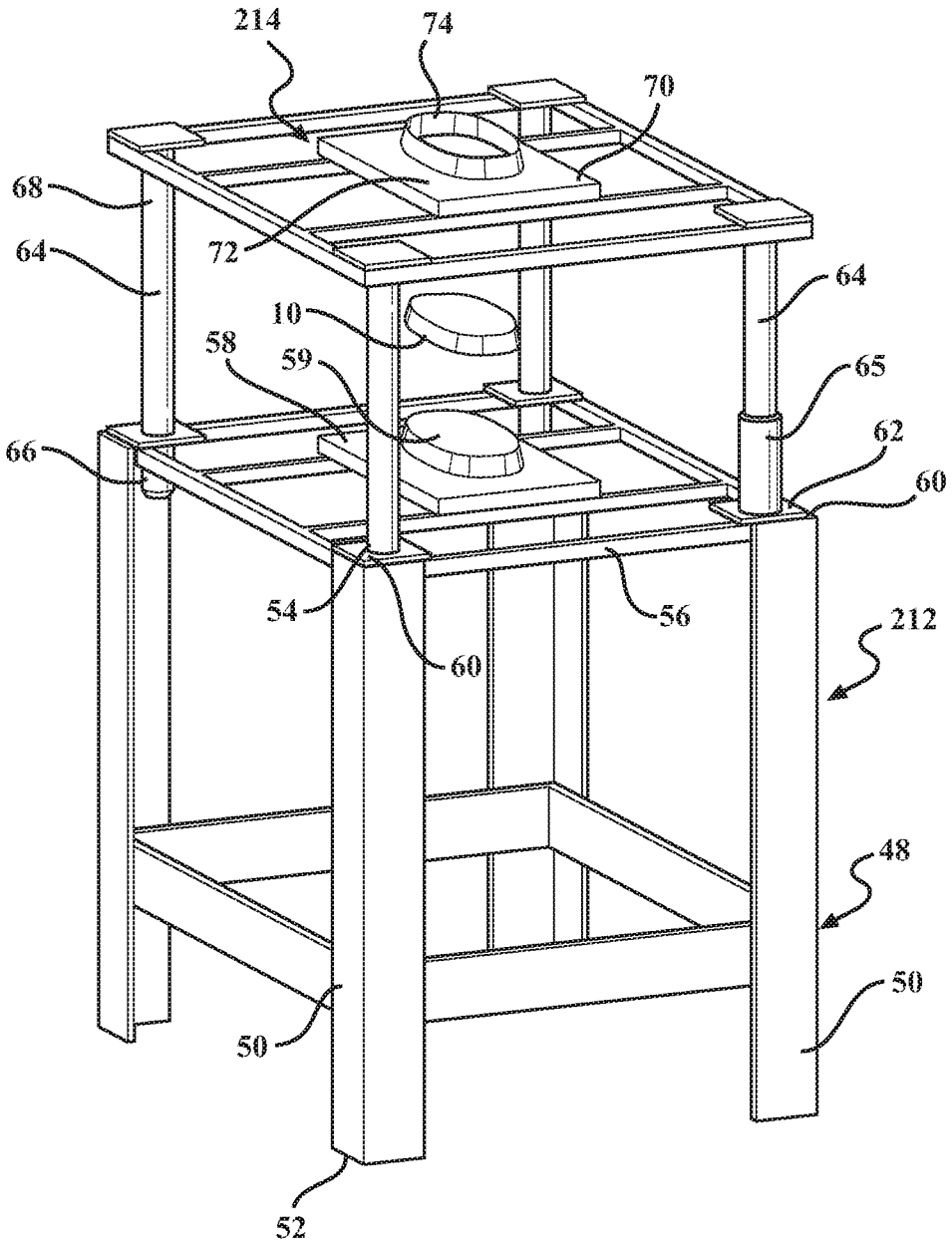
FIG. 5 is a perspective view of a mask and fixture assembly according to yet another aspect of the disclosure.

According to yet another aspect, as best presented in FIG. 5, a "permanent fixture" style system may be utilized. According to this aspect, the fixture 212 can include a lower support 48 that has a plurality of legs 50 which each extend between a lower end 52 and an upper end 54 in spaced and parallel relationship with one another. The lower support 48 can also include a lower shelf 56 that extends between the upper ends 54 of the legs 50. A nest 58 may be disposed on the lower shelf 56 which can include a protrusion 59 that has a shape that corresponds with the work piece 10 for receiving it in nesting relationship. It should further be appreciated that the work piece 10 may be grounded by way of the interface between the protrusion 59 and the work piece 10.

According to an aspect, the lower shelf 56 can present a plurality of corners 60 with a plate 62 disposed at each of the corners 60. A plurality of tubes 64 can each extend through one of the plates 62 and may each be moveably received by one of the legs 50. The tubes 64 may be connected to an actuator 65 (schematically shown) for providing linear movement to the tubes 64. It should be appreciated that various types of actuators 65 could be utilized. Each of the tubes 64 can include a lower portion 66 and a higher portion 68. An upper support 70 may be attached to the higher portion 68 of each of the tubes 64 for moving linearly up and down with the tubes 64. A mask 214 may be fixedly disposed on the upper support 70 in alignment with the protrusion 58. The mask 214 can includes a flat segment 72 and an outside wall 74 that extends upwardly from the flat segment 72 and has the same shape as the protrusion 58 and work piece 10 for being nested about the work piece 10. During operation, the work piece 10 may be positioned in nesting relationship on the protrusion 58. After the work piece 10 is in place, the upper support 70 and mask 214 may easily be lowered onto the work piece 10 by way of the tubes 64 and actuator 65.

After the coating operation is completed, the mask 214 may easily be removed from the work piece 10 by raising the upper support 70.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A method for painting a work piece of plastic material including:

applying a first coating of an electrically conductive material to the work piece;

electrically grounding the first coating of the work piece;

electrostatically charging a paint rendering the paint conductive for statically attracting the conductive paint toward the grounded first coating of the work piece;

overlying a mask over at least a portion of the first coating of the work piece;

electrically insulating the mask from the first coating of the work piece; and spraying the work piece with the conductive paint to apply a layer of paint on the first coating;

whereby the conductive paint is substantially prevented from being statically attracted toward the mask to increase the transfer efficiency of the conductive paint transferred to the first coating on the work piece.

2. The method for painting a work piece of plastic material as set forth in claim 1 wherein said step of electrically insulating the mask from the work piece includes utilizing a mask made of a non-conductive material.

3. The method for painting a work piece of plastic material as set forth in claim 2 wherein the non-conductive material is a rigid material.

4. The method for painting a work piece of plastic material as set forth in claim 2 wherein the non-conductive material is a plastic material.

5. The method for painting a work piece of plastic material as set forth in claim 4 wherein the plastic mask is formed from at least one of the following: a three-dimensional printing process, an injection molding process, and a thermoforming process.

6. The method for painting a work piece of plastic material as set forth in claim 1 further including attaching the work piece to a fixture prior to said step of spraying the work piece with the conductive paint, and wherein said step of electrically grounding the first coating of the work piece includes at least one of the following: grounding the entirety of the fixture, grounding a tab extending away from the fixture that is in engagement with the work piece or grounding a nest disposed on the fixture and which is configured to engage the work piece.

7. The method for painting a work piece of plastic material as set forth in claim 1 wherein said step of applying a first coating of an electrically conductive material to the work piece includes utilizing at least one of the following: an electroplating process, a physical vapor deposition process, a sputtering deposition process, a vacuum metalizing process, adding conductive pigments to the plastic material of the work piece, molding a Mylar film about the work piece and a conductive primer.

8. The method for painting a work piece of plastic material as set forth in claim 1 further including, removing the mask from the work piece, and curing the conductive paint on the work piece.

9. The method for painting a work piece of plastic material as set forth in claim 8 wherein said step of curing the conductive paint on the workpiece includes utilizing at least one of the following: a thermal curing process, an ultraviolet curing process, and a combination of the thermal curing process and the ultraviolet curing process.

10. A method painting a work piece of plastic material including:

applying a first coating of an electrically conductive material to the work piece;

fastening the work piece to a fixture;

electrically grounding the first coating of the work piece;

electrostatically charging a paint rendering the paint conductive for attracting the conductive paint toward the grounded first coating of the work piece;

spraying the work piece with the conductive paint to apply a layer of paint on the first coating; and overlying a mask over at least a portion of the first coating of the work piece prior to said step of spraying the work piece with the conductive paint, wherein the mask is of a rigid and non-conductive material for electrically insulating the mask from the first coating on the work piece for preventing the conductive paint from being statically attracted toward the mask to increase the transfer efficiency of the conductive paint applied to the work piece.

11. The method for painting a work piece of plastic material as set forth in claim 10 wherein the mask is formed of a plastic material.

12. The method for painting a work piece of plastic material as set forth in claim 10 wherein the mask is formed from at least one of the following: a three-dimensional printing process, an injection molding process, and a thermoforming process.

13. The method for painting a work piece of plastic material as set forth in claim 10 wherein said step of electrically grounding the first coating of the work piece includes at least one of the following: grounding the entirety of the fixture, grounding a tab extending away from the fixture that is in engagement with the work piece, and grounding a nest disposed on the fixture and which is configured to engage the work piece.

14. The method for painting a work piece of plastic material as set forth in claim 10 wherein said step of applying a first coating of an electrically conductive material to the work piece includes utilizing at least one of the following: an electroplating process, a physical vapor deposition process, a sputtering deposition process, a vacuum metalizing process, adding conductive pigments to the plastic material of the work piece, molding a Mylar film about the work piece; and a conductive primer.

15. A method for painting a work piece of plastic material as set forth in claim 10 further including removing the work piece from the fixture, removing the mask from the work piece, and curing the conductive paint on the work piece.

16. A method for painting a work piece of plastic material as set forth in claim 15 wherein said step of curing the conductive paint on the workpiece includes utilizing at least one of the following: a thermal curing process, an ultraviolet curing process or a combination of a the thermal curing process and the ultraviolet curing process.

17. A method of painting a work piece of plastic material including:

applying a first coating of an electrically conductive material to the work piece;

attaching a first connecting element of the work piece to a second connecting element on a fixture;

electrically grounding the first coating of the work piece;

electrostatically charging a paint rendering the paint conductive for attracting the conductive paint toward the grounded first coating of the work piece;

spraying the work piece with the conductive paint to apply a layer of paint on the first coating; and overlying a mask over at least a portion of the first coating of the work piece and securing a third connecting element of the mask to the work piece prior to said step of spraying the work piece with the conductive paint, wherein the mask is of a rigid and non-conductive material for electrically insulating the mask from the first coating on the work piece for preventing the conductive paint from being statically attracted toward the mask to increase the transfer efficiency of the conductive paint applied to the work piece.

18. The method of painting a work piece as set forth in claim 17, wherein the first connecting element of the work piece includes a pair of protrusions extending from the work piece, and wherein the second connecting element of the fixture includes a pair of clips that extending from the fixture and are configured to receive and fixedly engage the protrusions of the work piece.

19. The method of painting a work piece as set forth in claim 17, wherein the third connecting element of the mask includes a plurality of tabs positioned about a periphery of the mask.

20. The method of painting a work piece as set forth in claim 19, wherein securing a third connecting element of the mask to the work piece includes snapping the plurality of tabs of the mask about a periphery of the work piece.

* * * * *